US006082975A

United States Patent [19]

Lahens

[11] Patent Number: 6,082,975

[45] Date of Patent: Jul. 4, 2000

[54] COLD TURBOCHARGER CONSISTING OF A LOW MASS TURBINE SINGLE DISK UNIT

[76] Inventor: Albert Lahens, 200-37th St., Union City, N.J. 07087

[21] Appl. No.: 08/863,322

[22] Filed: May 27, 1997

[51] Int. Cl.[7] ..... F04D 25/04

[52] U.S. Cl. ..... 417/406

[58] Field of Search ..... 415/185; 417/405, 417/406, 407

[56] References Cited

U.S. PATENT DOCUMENTS

| | | | |
|---|---|---|---|
| 2,801,043 | 7/1957 | Spotz et al. | 417/406 |
| 3,173,241 | 3/1965 | Birmann | 417/406 |
| 4,093,401 | 6/1978 | Gravelle | 416/185 |
| 4,228,655 | 10/1980 | Hersmann et al. . | |
| 4,666,373 | 5/1987 | Sugiura | 416/185 |
| 4,709,552 | 12/1987 | Rutschmann et al. . | |
| 4,732,537 | 3/1988 | Kusz et al. | 417/407 |
| 4,781,027 | 11/1988 | Richter et al. . | |
| 4,993,228 | 2/1991 | Tashima et al. . | |
| 5,558,502 | 9/1996 | Fukazawa et al. . | |
| 5,563,490 | 10/1996 | Kawaguchi et al. . | |

FOREIGN PATENT DOCUMENTS

| | | | |
|---|---|---|---|
| 632856 | 12/1961 | Canada | 417/406 |
| 1027121 | 2/1953 | France | 417/406 |
| 59-5833 | 1/1984 | Japan | 417/406 |
| 563918 | 9/1944 | United Kingdom | 417/406 |

OTHER PUBLICATIONS

"Turbo–Mite" Miniature Gas Turbine, Propulsion Research Corporation, a subsidiary of Curtiss–Wright Corporation, Mar. 2, 1958, (copy in 417–406).

*Primary Examiner*—Michael Koczo

[57] ABSTRACT

An improved turbocharger pump having a turbine disk (10) with compressor impeller blades (16) attached to disk (10) and turbine impeller blades (12) mounted on the opposite side of disk (10). Disk (10) is supported by a non-rotating shaft (28). All components except shaft (28) are composed of a polymer based material. Disk (10) assembly is housed in a polymer based housing (26).

12 Claims, 6 Drawing Sheets

COLD TURBOCHARGER CONSISTING OF A LOW MASS TURBINE SINGLE DISK UNIT

BACKGROUND—FIELD OF INVENTION

This invention relates to turbochargers, specifically to such turbochargers which are used in internal combustion engines.

BACKGROUND—DESCRIPTION OF PRIOR ART

Turbochargers, or turbos have been in wide use since World War 2. The main function of a turbo is to force feed air into an engine. The pressurized air causes the engine to breathe better, and as a result the engine is able to deliver more power. Basically a conventional turbo consists of a turbine, and a compressor connected by a steel shaft. The turbine and compressor are housed separately in snail-like cast iron casings. The turbine housing is connected directly to the exhaust gas pipes of an engine. As exhaust gases from the engine pass over the turbine blades, the turbine begins to spin. This in turn causes the shaft to rotate, which rotates the compressor. The compressor sucks in air and force feeds it through a flexible pipe. The flexible pipe goes directly to the intake manifold. This is where the turbo feeds the engine pressurized air. Modern internal combustion engines are more efficient than engines produced thirty to forty years ago. Unfortunately, the same cannot be said about turbochargers.

For the most part turbochargers have remained relatively unchanged. The archaic configuration of a compressor, driven by engine exhaust is still in wide use today. One intrinsic flaw of exhaust driven turbos is turbo lag. Turbo lag is a delay of power between the time when the driver steps on the accelerator and the time when increasing exhaust gas flow causes the turbo to spin enough to pump a useful amount of air, or boost. This means a conventional turbo is completely dependent on the speed of the car.

Another chronic flaw of conventional turbos is the complexity they introduce into an engine bay. Some turbocharged cars employ intercoolers. Intercoolers are radiators that are used to remove heat from the air the turbo is pumping into the engine. This is done because hot air is not as conducive to combustion efficiency as is cold air. In the act of adding intercoolers to a car, the engine bay becomes clogged with tubes and radiators. As a result this makes servicing the engine a difficult task.

Conventional turbocharged engines are also more likely to break down. A conventional turbo works with exhaust gases, this causes the engine to operate at higher temperatures. As a result, conventional turbocharged engines must have more frequent oil changes than normally aspirated engines.

Despite the congenital defects of conventional turbos, car manufacturers today still employ them. U.S. Pat. No. 4,993,228 operates with a plurality of turbo superchargers. This turbo has the defect of relying on exhaust gases to drive the compressor. The disadvantages of having such a turbocharger have already been discussed. U.S. Pat. No. 4,781,027 employs twin exhaust gas turbochargers. Despite the use of two turbos to provide pressurized air, these turbos are still prone to the deficiencies already explained of conventional turbos. U.S. Pat. No. 4,709,552 is another example of the archaic conventional turbochargers. Again these exhaust driven turbos use the flow of exhaust gas to function. U.S. Pat. No. 4,228,655 uses a plurality of compressors driven by exhaust. The compressors are connected through check valves. The control valves are arranged to open sequentially as engine speeds increase and to close as engine speeds decrease. At idle, only one turbine is supplied with exhaust gas to start a supply of compressed air. Despite this fancy arrangement, these conventional turbos still operate with exhaust gas. This makes them prone to the inherent weaknesses previously explained. U.S. Pat. No. 5,558,502 is a turbo pump that operates on exhaust gases to spin the turbines. This turbo is of the same old conventional design. A turbine in one housing and a compressor fan in another, both connected by a steel shaft. The inefficiencies of such a system have already been discussed. U.S. Pat. No. 5,563,490 employs a turbo pump operated by a motor. This turbo pump negates the use of exhaust gas, however, it relies on an electric motor for operation. This turbo does away with the deficiencies present with exhaust driven turbos, but it is not a practical turbocharging system for automobiles. The current required for the electric motor to efficiently rotate the turbo pump would drain the car's electrical system, and it would further clog the engine bay. Overall, for use in internal combustion engines this is not an efficient turbo system.

In retrospect, conventional exhaust driven turbochargers suffer from a number of disadvantages:

(a) Are dependent on vehicle speed in order for turbo to pump a useful amount of compressed air.

(b) Conventional turbos cause engine temperatures to rise. As a result the engine is prone to breakdowns.

(c) Conventional turbos are housed in very heavy cast iron or steel casings, which adds more weight to the car.

(d) The use of intercoolers in turbocharged cars congest the engine bay, making it very difficult to service.

(e) Conventional exhaust driven turbos are very expensive to repair or replace.

OBJECTS AND ADVANTAGES

Accordingly, several objects and advantages of my invention are:

(a) to provide a turbocharger not dependent on engine speeds.

(b) to provide a turbocharger that is constructed of a plastic based material.

(c) to provide an increase of engine efficiency in terms of power at any rpm.

Further objects and advantages of my invention will become apparent from a consideration of the drawings and ensuing description.

DRAWING FIGURES

Figure 1:
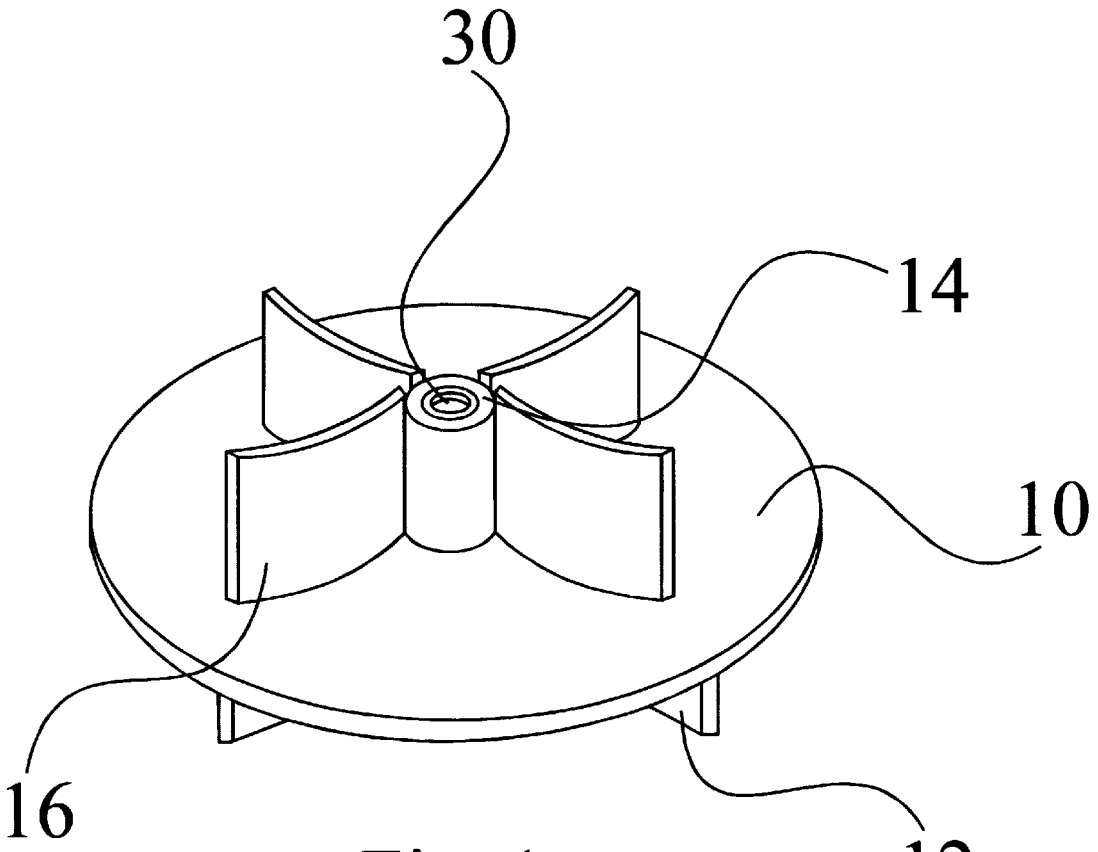
FIG. 1 shows an isometrical view of the turbo disk with the compressor blades on the top, and the turbine blades on the opposite side of the disk.

| Reference Numerals In Drawings | |
|---|---|
| 10 disk | 24 water outlet port |
| 12 turbine blades | 26 turbocharger housing |
| 14 hub | 28 shaft |
| 16 compressor blades | 30 ball bearing |
| 18 liquid inlet port | 32 nut |
| 20 air outlet port | |
| 22 air inlet port | |

DESCRIPTION—FIGS. 1–6

A typical embodiment of turbo disk is illustrated in FIG. 1. FIG. 1 shows a perspective view of turbo disk. Compressor blades 16 are joined to disk 10. Also attached to disk 10 is hub 14. Ball bearing 30 is placed inside hub 14. On the opposite side of disk 10 is attached turbine blades 12.

Figure 2:
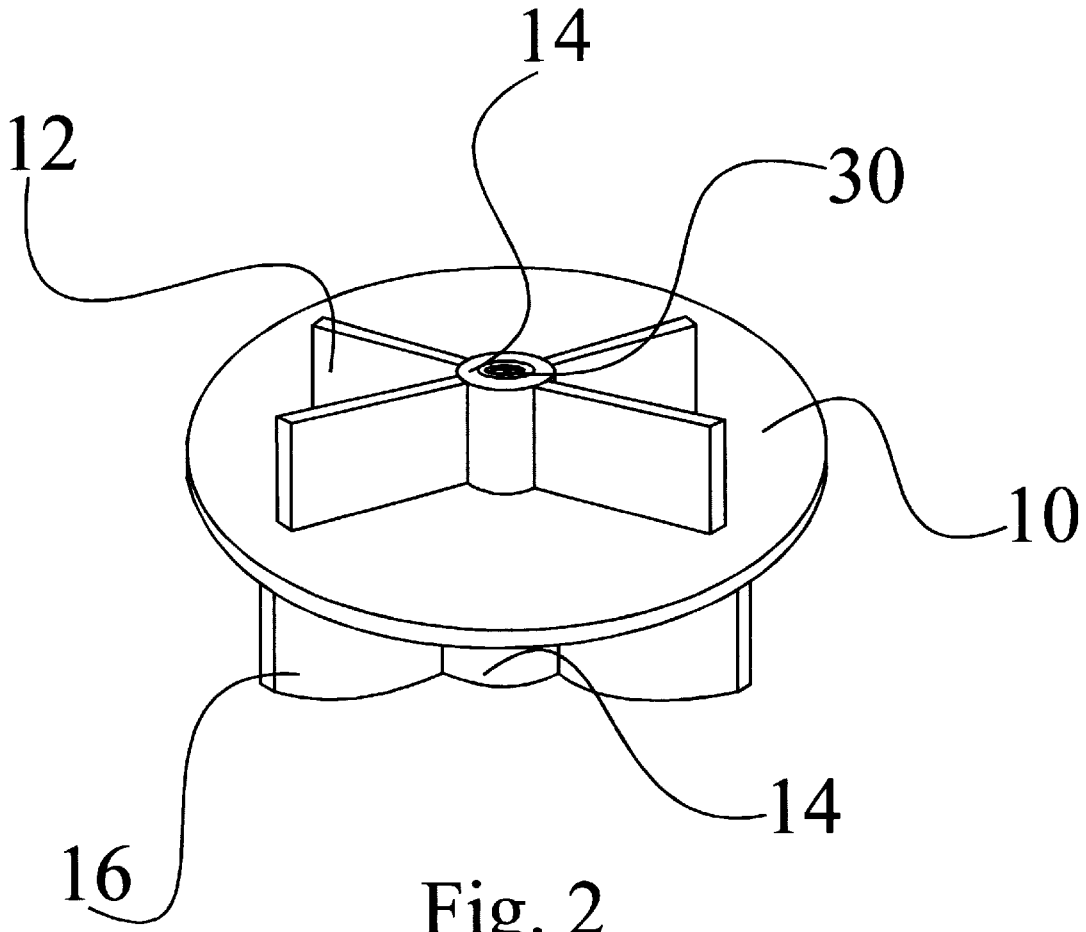
FIG. 2 shows an isometrical view of the turbo disk with the turbine blades on the top side, and the compressor blades on the opposite side of the disk.

FIG. 2 displays a perspective view of the opposite side of disk 10. From this view turbine blades 12 are attached to disk 10. Hub 14 is also attached to disk 10. Compressor blades 16 are shown on the underside of turbo disk 10 along with hub 14.

Figure 3:
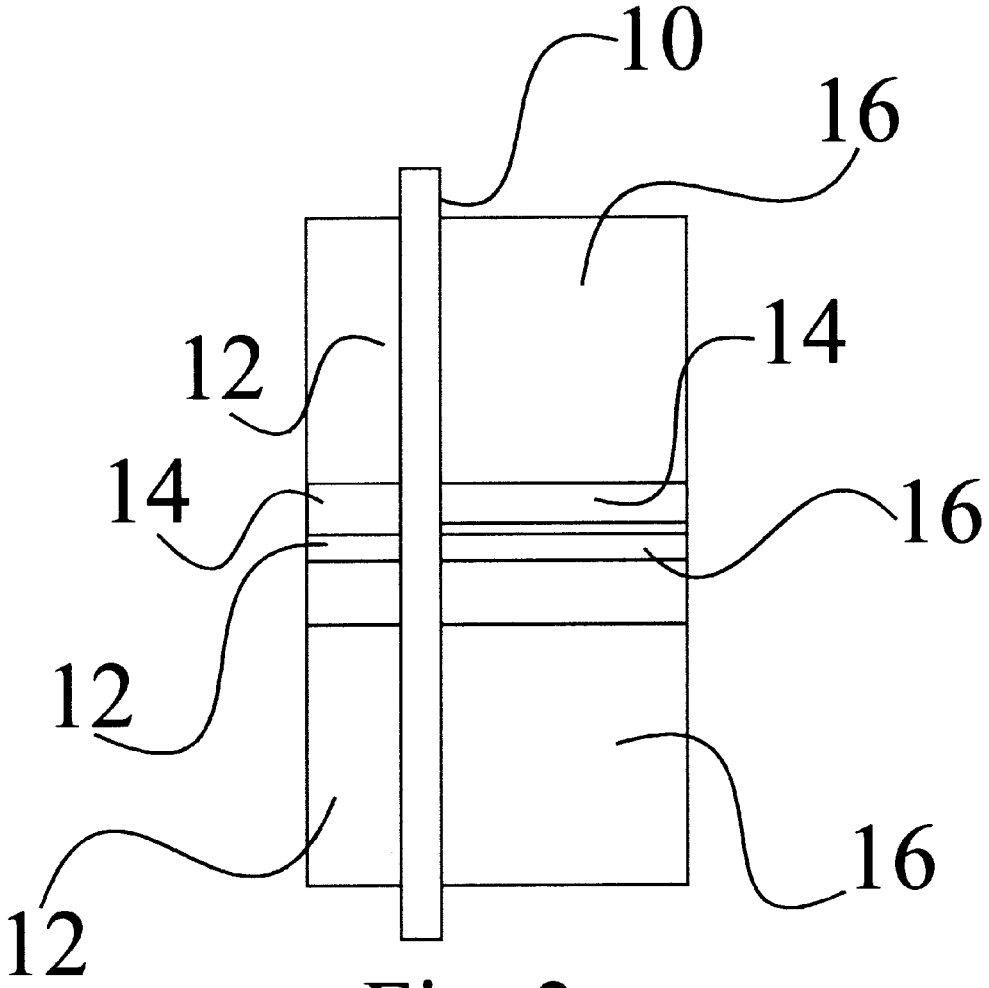
FIG. 3 shows a side view of the turbo disk with the compressor blades on one side and the turbine blades on the other side.

FIG. 3 displays a side view of turbo disk 10. From this view the compressor blades 16 are seen on one side of disk 10. Turbine blades 12 are shown on opposite side of turbo disk 10. The hub 14 is shown protruding from one side of disk 10 to the other side.

Figure 4:
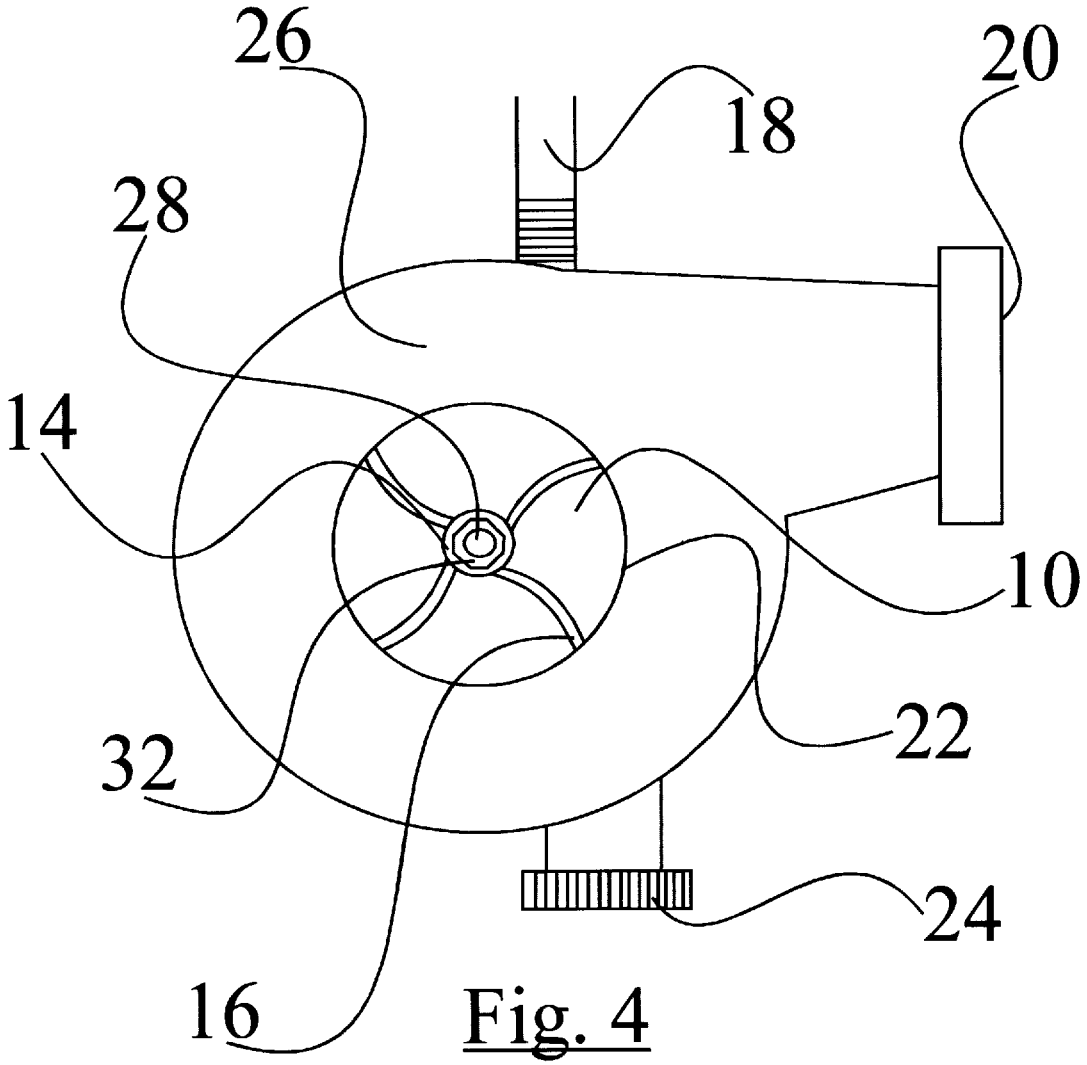
FIG. 4 shows a side view of the turbocharger housing, and the turbo disk in the interior portion with the compressor blades in view.

FIG. 4 shows a side view of the turbocharger housing 26. Also shown is the air inlet port 22. Inside port 22 is turbo disk 10. The compressor blades 16 and the hub 14 are shown on this side of the turbo. The air outlet port 20 and liquid outlet port 24 are also shown.

Figure 5:
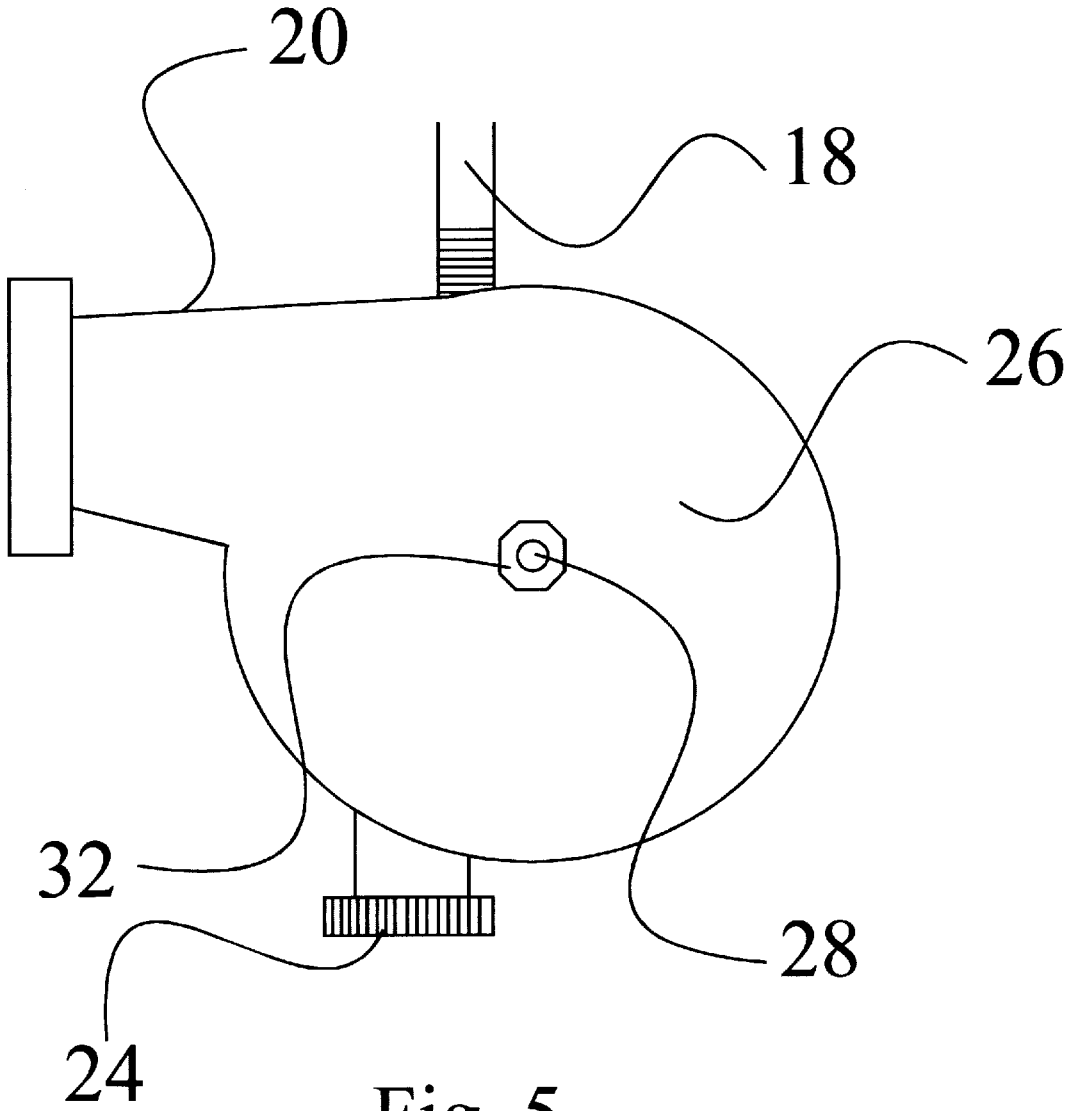
FIG. 5 shows a side view of the opposite side of turbocharger housing.

FIG. 5 shows a side view of the turbocharger housing 26. Shown in this view is the liquid inlet port 18 placed on the top portion of housing 26. At the bottom portion of housing 26 is the liquid outlet port 24. The air outlet port 20 is placed in a forward position.

Figure 6:
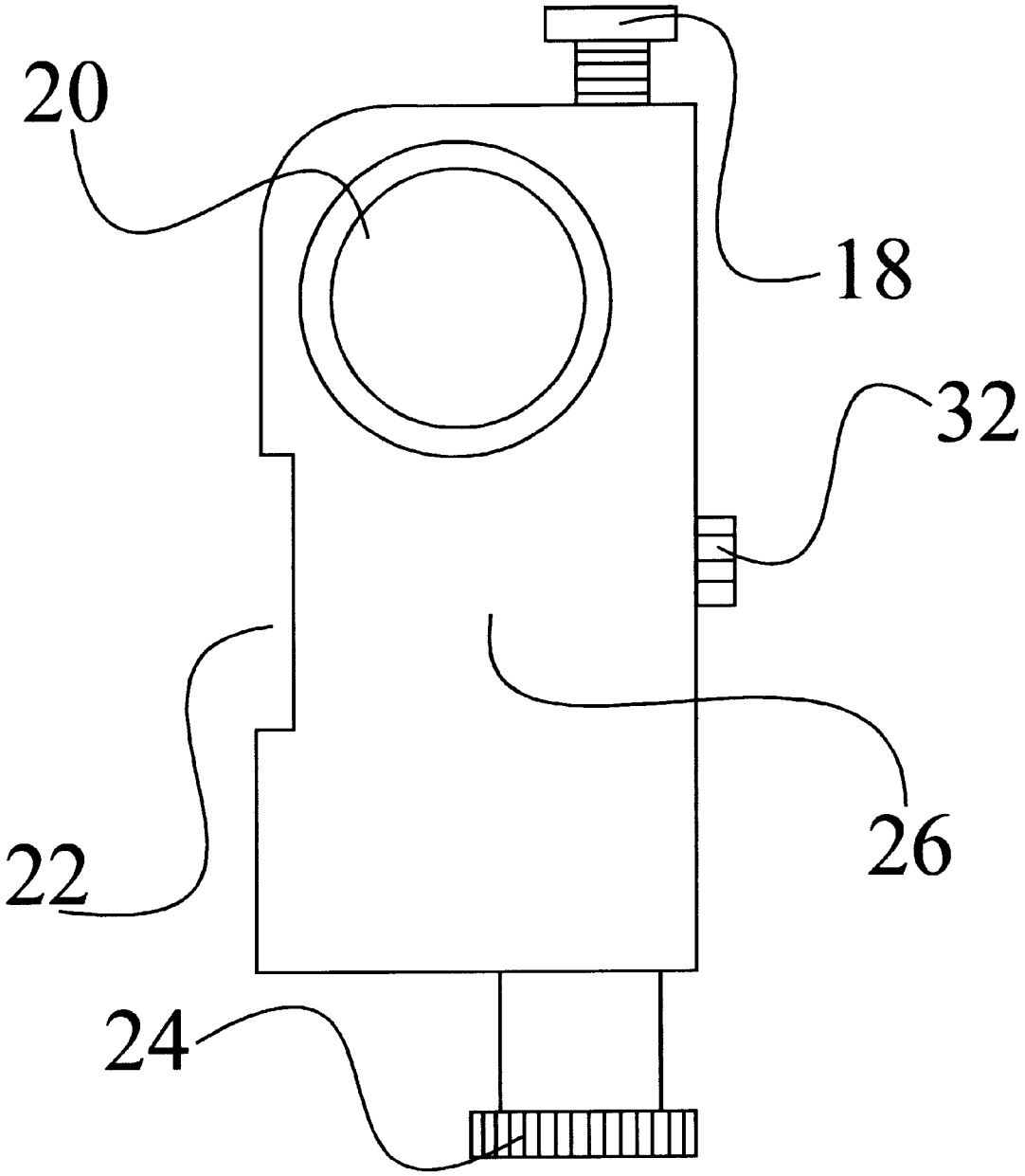
FIG. 6 shows a front view of the turbocharger housing.

FIG. 6 shows a front view of the entire turbocharger housing 26. The liquid inlet port 18 is placed on the top portion of housing 26. On the bottom side of housing 26 is placed outlet port 24. The air outlet port 20 is shown, and the air inlet port 22 on the side of housing 26.

Operation—FIGS. 1,2,3,4,5,6

The drawings of FIGS. 1, 2, and 3 show different views of the turbo disk 10 separated from the turbo housing 26. FIGS. 4,5, and 6 show the assembled form of the turbocharger which consists of a turbo housing 26 and disk 10. Turbo disk 10 rotates by high pressure liquid coming from inlet port 18. The high pressure liquid hits the tip portion of the turbine blades 12. As a result rotation is incurred from the kinetic energy of the pressurized liquid. As disk 10 rotates, compressor blades 16 on the oppossite side of disk 10 also begin to rotate. The rotation of compressor blades 16 produce a suction of air through inlet port 22. The pressurized air is then force fed out outlet port 20. From here the pressurized air is fed to the engine. Once the high pressure liquid delivers the kinetic energy needed to rotate disk 10, it falls to the bottom of housing 26. The liquid is then drained through port 24. Port 24 serves two functions. The first is to prevent the liquid from interfering with the rotation of disk 10 by draining it immediately. The second function is to return the liquid to a reservoir tank to be pumped back again at high pressure. Disk 10 has two main functions. The first function is to separate turbine blades 12 from compressor blades 16. Disk 10 prevents liquid from entering compressor blades 16. The second function of disk 10 is to reduce weight. This is done by attaching blades 16, and 12 to a single disk 10, which combines all in one rotating assembly. The turbo disk 10 assembly rotates freely on a non-rotating shaft 28. At both ends of hub 14 are located bearings 30. The bearings 30 are located inside hub 14. To prevent the turbo disk from moving laterally on the shaft 28, nuts 32 hold disk 10 firmly in place.

Summary, Ramifications, and Scope

Accordingly, the reader will see that this low mass single disk turbocharger offers many advantages.

compact design provides instantaneous power regardless of vehicle speed.

operates with relatively cold temperture liquid.

eliminates the need for extremely heavy components.

does not increase engine operating temperatures.

elimination of rotating axle

Although the description above accommodates many specificities, these should not be interpreted as limitaions on the scope of the invention, but rather as an illustration of one preferred embodiment thereof. Many other variations are possible. For example, the number of compressor, or turbine blades can be increased, or decreased. The compressor blades can be flat in design, or have a curvature. The turbocharger can be made of light weight metals such as aluminum.

Thus the scope of the invention should be determined by the appended claims and their legal equivalents, rather than by the examples given.

I claim:

1. A turbocharger pump comprising a housing with a high pressure liquid port positioned on top portion of said housing in such manner that said liquid inlet port is placed directly over outer the radial length of a plurality of turbine impeller blades and a liquid outlet port positioned on bottom portion of said housing and positioned, respectively, under said turbine blades and an air inlet port positioned on a lateral side of said housing partially exposing a plurality of compressor blades, and an air outlet port positioned on a side of said housing at a right angle to said compressor blades and a disk with said compressor impeller blades attached on one side extending in a radial manner to outer edge of said disk and said turbine impeller blades attached on the opposite side extending in a radial manner towards the outer edge of said disk, and a bearing mounted hub extending longitudinally across the widths of said compressor blades, said turbine blades and said disk, wherein said disk assembly is supported by a non-rotating shaft extending lengthwise across said hub and said shaft supported by said housing.

2. The turbocharger of claim 1 wherein said housing is made of a polymer based material.

3. The turbocharger of claim 1 wherein said disk is constructed of a polymer based material.

4. The turbocharger of claim 1 wherein said compressor blades are curved.

5. The turbocharger of claim 1 wherein said hub is supported by said bearings at each free end of said hub.

6. The turbocharger of claim 1 wherein said turbine impeller blades are curved.

7. In a turbocharger pump assembly comprising a disk with a plurality of compressor impeller blades attached on one side, and a plurality of turbine impeller blades attached on the opposite side of said disk, and a bearing mounted hub extending longitudinally across the widths of said turbine blades, said compressor blades and said disk, wherein said disk assembly is supported by a non-rotating shaft extending the length of said hub and supported by a housing with air and liquid inlet and outlet ports.

8. The turbocharger of claim 7 wherein said housing is made of a polymer based material.

9. The turbocharger of claim 7 wherein said disk is constructed of a polymer based material.

10. The turbocharger of claim 7 wherein said compressor blades are curved.

11. The turbocharger of claim 7 wherein said hub is supported by said bearings at each free end of said hub.

12. The turbocharger of claim 7 wherein said turbine impeller blades are curved.

* * * * *